United States Patent [19]

Rogers

[11] Patent Number: 4,835,371

[45] Date of Patent: May 30, 1989

[54] DIVING COMPUTER

[76] Inventor: Raymond E. Rogers, 11996 Scenic Hwy., #109, Pensacola, Fla. 32514

[21] Appl. No.: 113,173

[22] Filed: Oct. 26, 1987

Related U.S. Application Data

[63] Continuation-in-part of Ser. No. 20,799, Mar. 2, 1987, abandoned, which is a continuation-in-part of Ser. No. 776,048, Sep. 13, 1985, abandoned.

[51] Int. Cl.[4] ..... G06C 3/00

[52] U.S. Cl. ..... 235/88 R; 235/78 R

[58] Field of Search ..... 235/78 R, 78 N, 78 RC, 235/85 R, 85 FC, 87 R, 88 R, 88 N, 88 RC; 364/418

[56] References Cited

U.S. PATENT DOCUMENTS 3,698,630 10/1972 Dick et al. ..... 235/78 R 3,923,243 12/1975 Barron ..... 235/88 R 4,369,358 1/1983 Adams ..... 235/87 R

*Primary Examiner*—B. R. Fuller

*Attorney, Agent, or Firm*—Jones, Askew & Lunsford

[57] ABSTRACT

Disclosed is a diving computer in the form of a circular slide rule for aiding a SCUBA diver in planning one or more dives within a short amount of time, including more than one depth per dive, so that the diver may avoid risking decompression sickness. The computer has two faces, one of which calculates the increase of pressure within body tissues during a dive and the other of which calculates the decrease of this pressure after surfacing. The result of one side's calculation is used as the initial value for the other side's calculation, permitting the diver to track net residual pressure over a series of rapid repeated and/or multiple-level dives, and by so doing, avoid excessive tissue pressures that might cause decompression sickness.

10 Claims, 8 Drawing Sheets

DIVING COMPUTER

This applicaiton is a continuation-in-part of Ser. No. 020,799 filed 3/2/1987 and now abandoned, which was a continuation-in-part of Ser. No. 776,048 filed 9/13/85 and now abandoned.

BACKGROUND OF THE INVENTION

1. Field of the Invention

The present invention relates to a circular slide rule apparatus which may be used by recreational divers to enhance their safety while simultaneously increasing the amount of time permitted for their dives, and to provide a systematic procedure for operating at more than one depth during a single dive.

A risk of diving with a Self Contained Underwater Breathing Apparatus (SCUBA) is the development of decompression sickness (hereafter called DSC, but commonly called "the bends"). DCS is a general term that includes a number of signs and symptoms whose common etiology is the formation of inert gas bubbles in one or more parts of the body and whose most frequent manifestations are joint pain and central nervous system damage, ranging in severity from temporary mild discomfort to sudden death. While many different gas combinations are used in military and commercial diving, recreational divers typically breathe comprssed air, which is 79% nitrogen, and nitrogen is the inert gas relevant to this discussion.

A recreational diver at depth breathes air at a pressure greater than at the surface and becomes of this gradient, nitrogen passes through the lung membranes into solution in the blood, and from there into the various tissues of the body, at varying rates that depend upon the magnitude of said pressure gradient and upon characteristics of each of said various tissues. When the diver returns to the surface, the reverse process occurs: the higher pressure nitrogen dissolved in the blood passes through the lung membranes and is exhaled, and as the nitrogen pressure in the blood diminishes, dissolved nitrogen passes from the tissues to the blood until eventually all portions of the body have reached equilibrium with atmospheric pressure; stated simply, pressure changes flow from high to low.

If a diver stays at a given depth of water long enough for any of his tissue pressures to exceed the limit at which it becomes impossible to undergo this normal process of gas elimination, and said tissue pressure is sufficiently greater than that of the surrounding environment, then nitrogen bubbles can form in a body tissue and that diver could develop DCS. To minimize this risk, the diver must either avoid such depth and time combinations, or must undergo the procedure known as decompression, which requires staying at predetermined depths for predetermined time periods so as to eliminate the dangerous excess of nitrogen pressure. In recreational diving, decompression is considered to be an emergency procedure only, for use when well known time/depth limits, or no-decompression limits, have been accidentally exceeds. Because of the dangers associated with the procedure, it is not considered to be an elective option.

If a diver planned only a single dive to a single depth, the requirements would be simple: the diver should never exceed the empirically determined no -decompression limit for that depth. However, it is commonplace for divers to perform two or more dives in succession, and the excess nitrogen in the body cannot reach equilibrium with the atmosphere in the short time span(s) between dives. Thus, a diver would reenter the water with a tissue nitrogen pressure greater than atmospheric, and must allow for said greater pressure in computing the maximum time permissible at depth during a subsequent dive. To avoid decompression procedures, a satisfactory adjustment factor must be employed. It is therefore essential that the recreational diver have a means instantly available at all times to compute with speed, ease, and precision the amount of time which he can spend at any depth without exceeding the limit of time for that depth, and if more diving is planned within a short period, he/she must alsod be able to calculate the amount of nitrogen pressure lost during the time spent on the surface between dives, so that the net accumulation and loss of nitrogen pressure in the body tissues may be safely and accurately tracked over a succession of dives.

2. Prior Art

Studies relating to the hazards of diving go back for centuries. There is a very extensive body of literature dealing with the theoretical model of decompression developed by the British physiologist J. S. Haldane in his landmark paper of 1907, which is the foundation of hyperbaric (greater than atmospheric pressure) physiology, and which first provided decompression information in tabular format, commonly called "tables", to sever as a safety guide for divers and caisson workers. Many different tables have been developed over the years, new tables appear periodically, research is ongoing, and more tables may be expected. Since virtually all tables ever constructed are based ultimately on Haldane's work, a brief discussion of a relevant portion of it is appropriate. (The English system of measurements is used herein, but metric values could easily be employed by making the appropriate conversions.)

DEFINITIONS

ATMOSPHERIC PRESSURE at the surface is 14.7 #/in$^2$, and is considered to be equal to the weight of a column of water 33 feet high and one square inch in cross-section, denoted as 33 feet of sea water absolute (33 FSWA).

AMBIENT PRESSURE is the pressure of the immediate environment, is usually expressed as FSWA, and is the sum of atmospheric pressure plus depth (for example, at 100 feet of depth, ambient pressure is 33+100=133 FSWA).

INITIAL TISSUE PRESSURE is the pressure within a tissue at the beginning of a given pressure differential.

TIME is the number of minutes to which a tissue has been exposed to a given pressure differential.

FINAL TISSUE PRESSURE is the pressure within a tissue at the end of a given pressure differential and time span.

TISSUE HALFTIME is the time required for a tissue exposed to a pressure differential to gain or lose pressure equal to one-half of said differential, said time being constant regardless of the magnitude of the differential.

The speed with which a body tissue comes to equilibrium with its environment after exposure to a pressure differential does not vary linearly, but rather exponentially, and the exponential constant of tissue halftime varies from tissue to tissue. The equation that describes this phenomenon is commonly called the "Haldane equation", and is usually expressed in one of two forms:

$$Q=P+(1-2^{-(T/H)})(N-P)$$

$$P_t=P_o+(P_a-P_o)(1-e^{(ln\ 0.5)(t/T\frac{1}{2})}$$

WHERE:

$P=P_o$=Initial tissue pressure
$N=P_a$=Ambient pressure
T=t=Time of exposure
$H=T\frac{1}{2}$=Tissue halftime
$Q=P_t$=Final tissue pressure
e=base of natural logarithm In may work, the first form was used. Thus, if N>P, then Q increases, and if N<P, then Q decreases. Stated simply, tissue pressure moves toward ambient pressure. If depths and their corresponding times are known, tissue pressures may be computed for any given tissue for any given moment. Since it is obviously impractical to solve complex mathematical equations while diving, tables may be created from application of the Haldane equation and said tables can provide a diver with precalculated solutions to at least some of the virtually limitless combinations of depth and time.

A complication of the construction of any such tables relates to the large number of tissue halftimes that theoretically exist within the body. It is not essential to deal mathematically with all the theoretical tissue halftimes, but a sufficient sampling properly selected is called for. In practical terms, it is typical to work with six to eight tissue halftimes. Ideally there should be a separate set of tables for each tissue halftime, and a diver would select the shortest dive time that would be obtained from said plurality of tables. Such a procedure would be unwieldy, time-consuming, and fraught with potentiald for error. The customary compromise lies in carefully selecting a single tissue halftime on which to base the mathematical calculations of the particular tables, said tissue halftime being the one most suitable to the nature of the diving which the particular tables anticipate, said suitability being determined by that tissue which is slowest of all in reaching equilibrium with the atmosphere within the maximum time span encompassed by the particular tables, so that all other tissues reaching equilibrium more rapidly than said slowest of tissues may be deemed to be safely less than their physiological limits. Paraphrasing, if a table is based on a tissue halftime that is large, it will be safe for all tissues with lesser halftimes, and will be excessively conservative with respect to all such lesser halftimes.

For decades after publication of Haldane's tables, hyperbaric information was presented only in a tabular format. More recently, submersible electronic computers have become available, but have gained little acceptance because of their high cost; thus the effective state of the art remains as tables. "Tables" typically consist of a simple plastic card on which is printed or engraved a plurality of depth and time relationships from which resultant pressures may be interpolated. Further, they typically consist of three separate tabular displays: the first calculates nitrogen pressure increase at depth, the second calculates nitrogen pressure decrease at the surface, and the third calculates a residual nitrogen pressure time penalty that must be applied to a subsequent dive.

All tables suffer common weaknesses. (1) It is impossible to display a sufficient amount of information on a submersible card without making that card impractically large or without making the characters printed or engraved thereon impractically small; expressed conversely, any submersible card which is conveniently portable and stowable, and which has characters that are readily legible will be necessity be unduly restricted in the amount of data it presents, or too "coarse". (2) Visual clutter and mental confusion are created by the display of a large body of numbers that are, in the last analysis, non-essential, because all that such numbers represent are a few episodic solutions to Haldane's equation for a very limited number of the possible depth/time combinations. (3) The afoementioned necessity of biasing tables on a single tissue halftime forces the table designer to make a difficult choice between danger and excessive conservatism, a problem that is impossible to resolve completely; the best that can be achieved is to correlate the tissue halftime selection with the character of the diving activity and the type of divers that the tables are intended to serve. Thus, the prior art has consisted of the construction of many different sorts of tables, but still tables nevertheless, with all their innate deficiencies.

My investigations of these deficiencies revealed many more and unexpected inadequacies in the existing tables: they are to a high degree a product of limited research that generated a hodge-podge of empirical values that followed no particular plan or unifying concept; in addition, I found many inconsistencies and outright errors. The most widely used of all tables are variations of those produced in 1957 by the U. S. Navy for the use of its divers. Two points in particular make these tables unsuitable for recreational divers: (1) the no-decompression limits are far too great for the safety of the typical diver whose physical condition is inferior to that of a military diver, hence these tables are dangerous for use in single dives, and (2) said tables were designed as decompression tables to be used by first intent in situations requiring decompression, said tables thereby requiring the use of a tissue halftime far too grat to be appropriate for the use of recreational divers; hence said tables are excessively convervative for repetitive dives and are unnecessarily and unfairly restrictive of permissible time for such divers. The problem lies less with said tables than it does with those who adopted them for a purpose alien to their creation. It gradually became apparent to me that promulgation of entirely new and properly done tables would be a large improvement over the long-accepted status quo, even though such tables would inevitably bear all the aforementioned problems that are inherent in tables.

Long study and hard work showed that three principal changes would overcome a high percentage of the problems of existing tables. The use of lower no-decompression limits would improve safety. The use of a greater number of columns would increase precision and reduce unnecessary time penalties resulting from excessive "rounding-up" to next greater times and depths. The use of a more suitable tissue halftime intended for recreational diving, not military or commercial, would be of extreme importance. Recreational diving defines itself as stopping short of no-decompression time limits, and short of the relatively modest depth limit of 130 feet. Because these limitations exist, tissues with high halftimes are unable to reach their danger levels anywhere within the exposure matrix of recreational diving. It is therefore practical to ignore the tissue on which the U.S. Navy (necessarily) based its tables.

The Nvay used a tissue halftime of 120 minutes, meaning that 2 hours are needed for said tissue to undergo half of a potential pressure change. The Navy's choice was entirely appropriate for its type of diving, but is quite unrealistic when adopted by others for recreational use. the 120 minute tissue never reaches its limit in recreational diving. It was necessary o determine which tissue would be most appropriate; extensive computer analysis of the problem revealed that tables based on a 40 minute tissue halftime would be very desirable, but a certain percentage of dive situations would not be adequately protected by such tables. Diver safety being more important than diver convenience, I determined that tables based on the 60 minute tissue halftime would be much safer and only slightly more restrictive than "40 minute tables". Classically, the theoretical tissue designated as 60 minutes has been ignored by most researchers who would be use 5, 10, 20, 40, 80, and 120, thereby overlooking the tissue most useful to that segment of the diving population which performs the overwhelming majority of all dives.

The deficiencies in the existing methodology described previously are so glaring that It was curious why nothing had been done about them. In time, I can to realize that those persons who have substantially knowledge of mathematics, computer technology, physics, chemistry, anatomy and physiology, as well as a keen interest in hyperbarics and diving are probably numbered in the dozens, worldwide, and most of them are involved in research of a highly sophisticated nature, and have been unable to devote their time and expertise to the problems of recreational divers. If such persons had spent as many hundreds of hours on the subject as I have, they might possibly have devised a similar type of solution, but clearly no one cared enough to thought enough to do so.

The literature includes numerous examples of graphs of how tissue pressures change with respect to various combinations of depth/time exposures, but such graphs, which have been mere academic illustrations in the usual "x, y" format, have no practical utility for a recreational diver. Nowhere in the literature have i seen a polar format used by any author to present such information. In addition, no mechanical device has ever been made, in polar format or otherwise, that will calculate continuous solutions to the Haldane equation (except for the aforementioned submersible electronic computers which are completely different in nature from the instant invention). Furthermore, current table systems do not provide for or permit those calculations necessary for driving at multiple levels within a single dive, a procedure called multi-level diving which is considered to be highly desirable.

SUMMARY OF THE INVENTION

Adaptation of the aforementioned depth/time/pressure graphs could have been done a long time ago, but to my knowledge no person has ever attempted to achieve any dynamic or functional benefit from such graphs. My invention produces such benefits. If the relevant equation is used to plot curves of a sufficiently large number of possible exposures, and if a means is devised to employ these plots in practical situations, then great advantage may be gained from what are otherwise merely static, academic plots. Accordingly, it is an object of this invention to provide an inexpensive, portable, immersible calculating instrument which is capable of solving the Haldane equation and calculating exact decompression limits for repeated SCUBA dives, which permits easy calculations at the surface and at depth, and which is capable of making those calculations necessary for diving at multiple levels within a single dive.

Extensive trial and error demonstrated to me that it is possible to display the maximum amount of information with the least confusion by utilizing a polar plot means. A polar format lends itself easily to the devising of a circular slide rule which would have great utility, accuracy and ease of operation underwater for the recreational diver. Furthermore, such a format could easily perform those calculations necessary for multi-level diving, thereby permitting such practices. Accordingly, there is provided a circular slide rule having two sides, so that a solution from one side can be used as the initial value for a calculation by the other, thus enabling one to efficiently calculate a diver's pressure status, and plan additional dives, even after the diver has made repeated dives during a short time span. Each side of the slide rule is a plot of differntial pressure as a function of time, the radial polar coordinate being tissue pressure, and the angular polar coordinate being time.

When the idea of creating the circular slide rule first occurred to me, I found it impossible to adapt the existing tables with their errors and inconsistencies to the said circular slide rule format. It was necessary to develop my own algorithm which is not only adaptable, but far more logical and consistent with published data, said algorithm being a portion of the material bearing copyright numbers TXu 278 551 and TXu 291 717.

In the preferred embodiment, the pressure ranges are chosen to correspond to the hydrostatic pressure at depths typically encountered by recreational divers, and the time scales similarly are chosen to correspond to the lengths of time a diver could stay at these depths without requiring decompression upon surfacing. The time scale (angular coordinate) on the first side is linear and on the second side is exponential, for reasons that will be developed later. The tissue pressure scale (radial corrdinate) is linear on both sides.

A solution to the dilemma of presenting a very large amount of information relevant to recreational diving within a very small area is made possible by a circular slide rule type device which:

(1) provides a distinctive and novel rotational mechanical means for computing the inert gas pressures within the tissues of the body of a SCUBA diver who has been exposed to pressures greater than atmospheric, (2) utilizes the numerical values of those quantities actually measured by the diver (time and depth) and uses no other numbers, (3) correlates these numerical values of time and depth by rotational mechanical means to compute the tissue pressures that are the solutions to an exponential (Haldane's) equation, (4) is capable of making such computations at any given phase of diving activity however long, involved or complex such activity might be, (5) presents said tissue pressures by graphic means as continuous curves containing all the solutions to said equation and not merely a few episodic solutions, (6) indicates by graphic means the maximum safe time limit for any given dive including single, repeated, multiple-level, and repeated multiple-level dives, (7) eliminates the need for most of the vast body of numbers that conventional tables require, (8) requires use of lower no-decompression limits than the most widely used of existing tables thereby enhancing diver safety,.

(9) employs a different and more realistic tissue half-time than said tables, thereby greatly improving the length of time that a diver may stay at depth on subsequent dives even as said diver safety is enhanced, and

(10) provides by first intent computational means of permitting the practice of diving safely at more than one depth during a single dive.

The diving computer summarized herein provides divers with means that will simultaneously display a much greater amount of information and more particularly provides a much greater degree of precision than heretofore available by any means other than submersible electronic computers, and further provides a means that is simpler to use, safer for the diver, fairer to the diver in the amount of time permitted on subsequent dives, broader in application than currently accepted methods, while being portable, stowable, durable, immersible and economical.

DESCRIPTION OF THE PREFERRED EMBODIMENT

Figure 1:
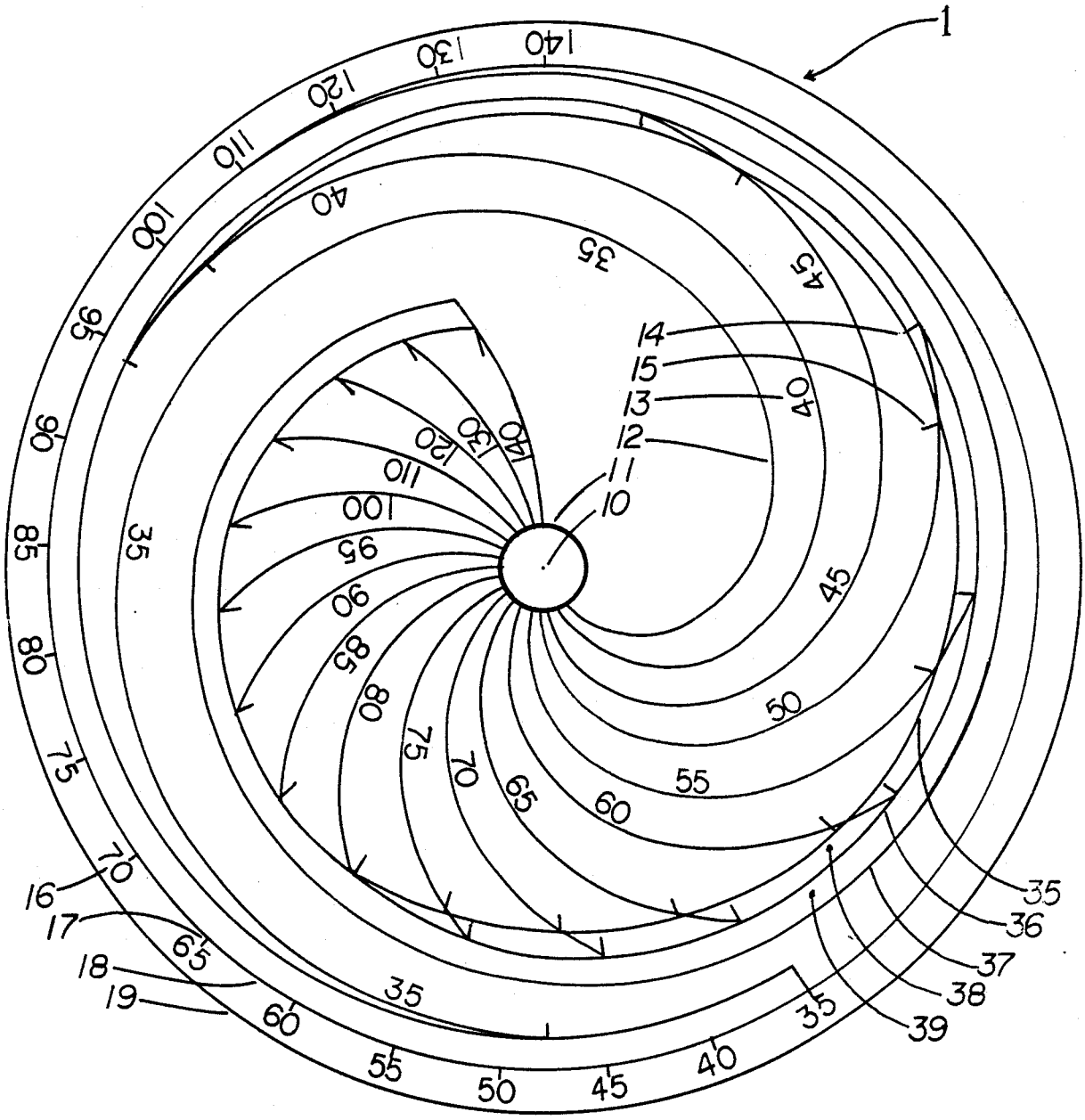
FIG. 1 shows the inscriptions on the front surface of the base of the diving computer of the present invention.

The instant invention is a circular slide rule which can enable a recreational SCUBA diver to make all calculations necessary to increase safety, increase permissible dive time, and broaden the scope of diving activity by instituting the practice of multi-level diving.

The invention is comprised of a planar base member which has a circular face on its front side and a circular face on its rear side, said faces being aligned so that an axis of rotation positioned perpendicularly to and projecting through both sides of said base member passes through the centers of said circular faces, and provides both attachment and rotational means for rotors centered on said axis and denoted as a first front rotor which is a circular disc positioned over the circular face of the front side of the base member, a second front rotor which is approximately one-sixth of a circular disc positioned over said first front rotor, and a rear rotor which is a circular disc positioned over the circular face of the rear side of the base member. Said faces and rotors are inscribed with markings, curves, and indicia which will be described fully and are adequate to implement the invention's stated purposes, are assembled in the order described so that said faces and rotors share common centers, and said rotors are rotatable with respect to the circular faces of the base member. All materials used to construct said axis of rotation, base member and rotors must be impervious to the deleterious effects of salt water immersion. In the contemplated commercial application, plastic will be used for the rotors and base member; the axis of rotation will be a commercially available stainless steel spring washer.

To describe the drawings in detail, this simpler nomenclature shall be used:

| | |
|---|---|
| planar base member | base 6 |
| circular face of front side of said member | front face 1 |
| circular face of rear side of said member | rear face 4 |
| first front rotor | front rotor 2 |
| second front rotor | cursor 3 |
| rear rotor | rear rotor 5 |

Figure 8:
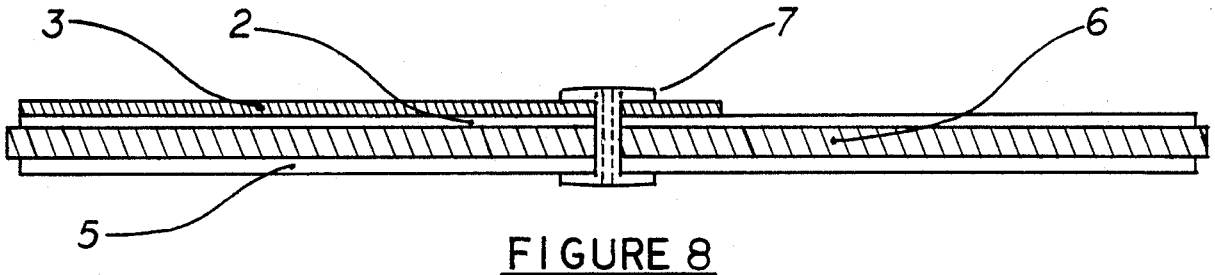
FIG. 8 is a cross-sectional view of the diving computer of the present invention, showing a cursor, a front rotor, a base, and a rear rotor assembled.
Figure 4:
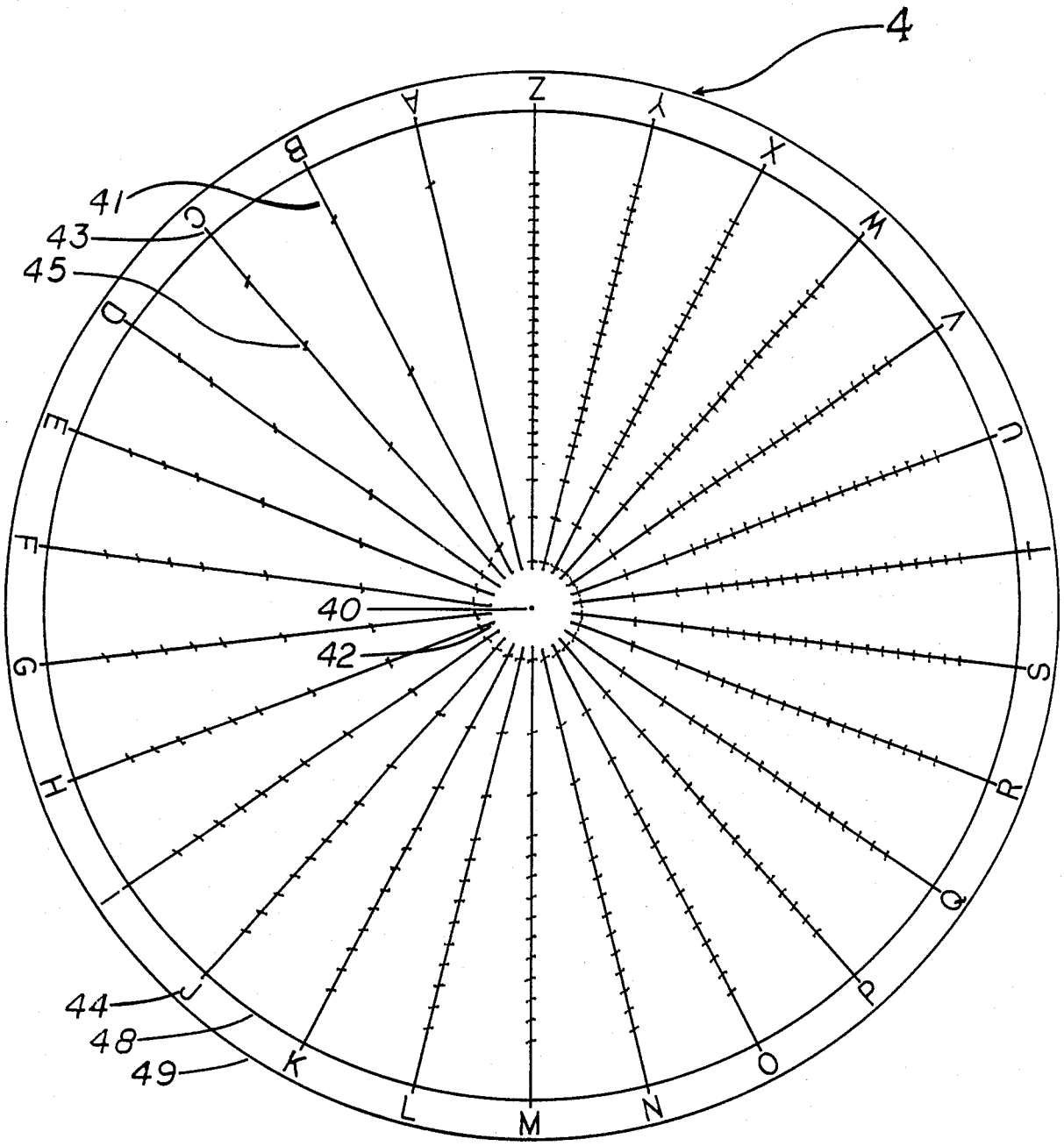
FIG. 4 shows a portion of the inscriptions on the rear surface of the base of the diving computer of the present invention.
Figure 5:
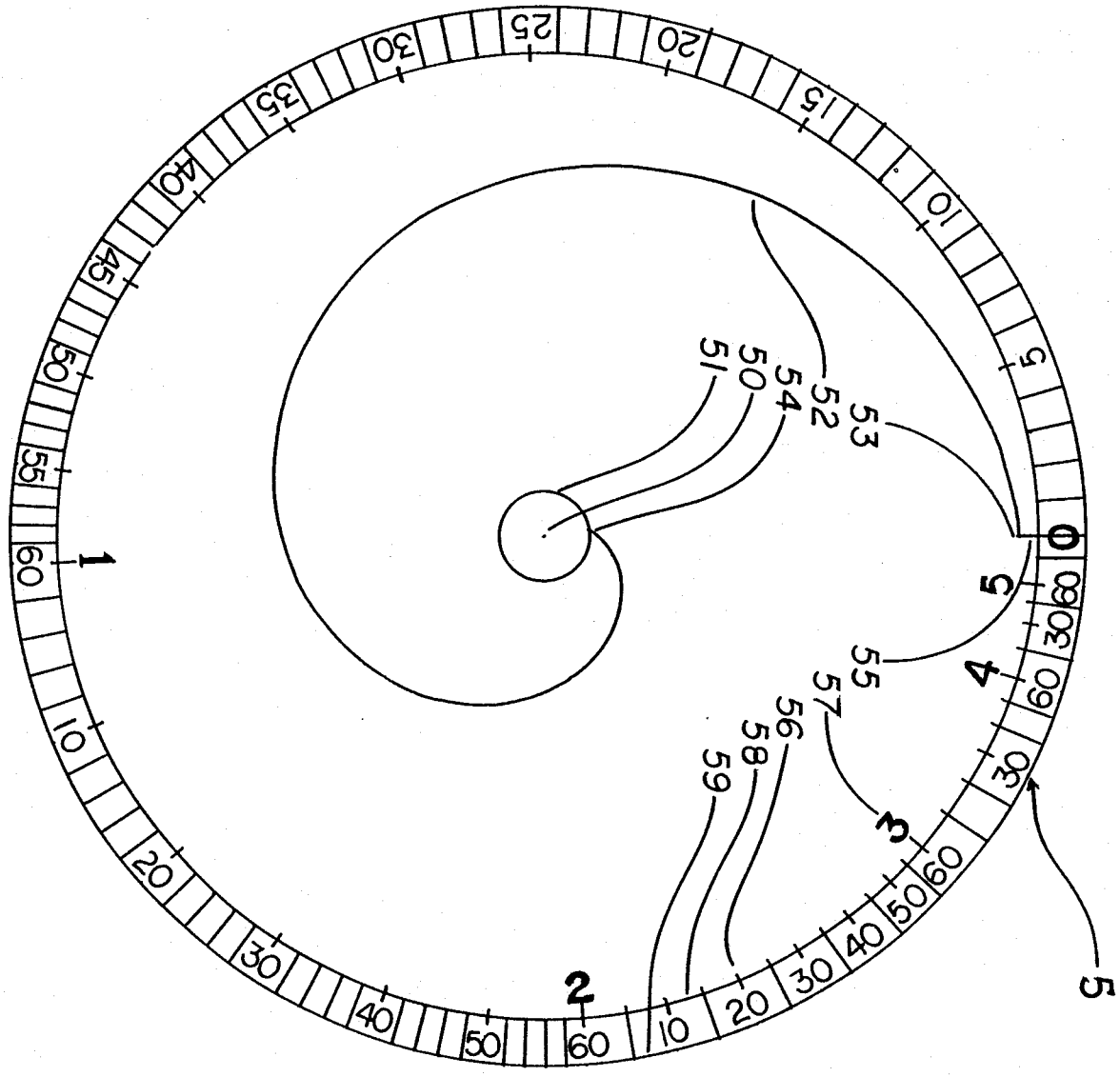
FIG. 5 shows the inscriptions on the rear rotor of the diving computer of the present invention.
Figure 6:
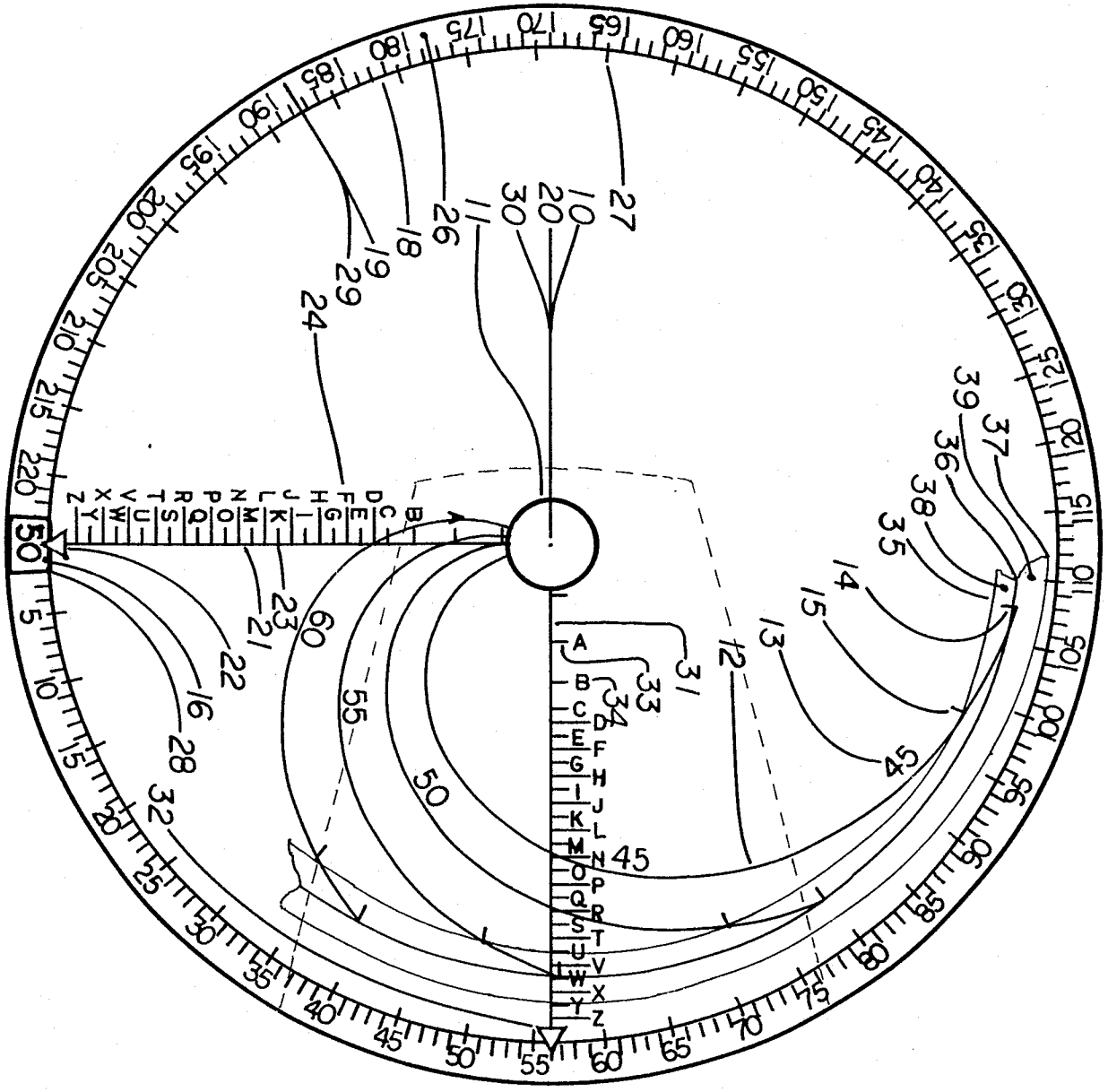
FIG. 6 is a front plan view of the diving computer of the present invention, showing the front surface of a base bearing the inscriptions of FIG. 1, a front rotor bearing the inscriptions of FIG. 2, and a cursor bearing the inscriptions of FIG. 3 assembled to demonstrate the performance of a calculation.
Figure 7:
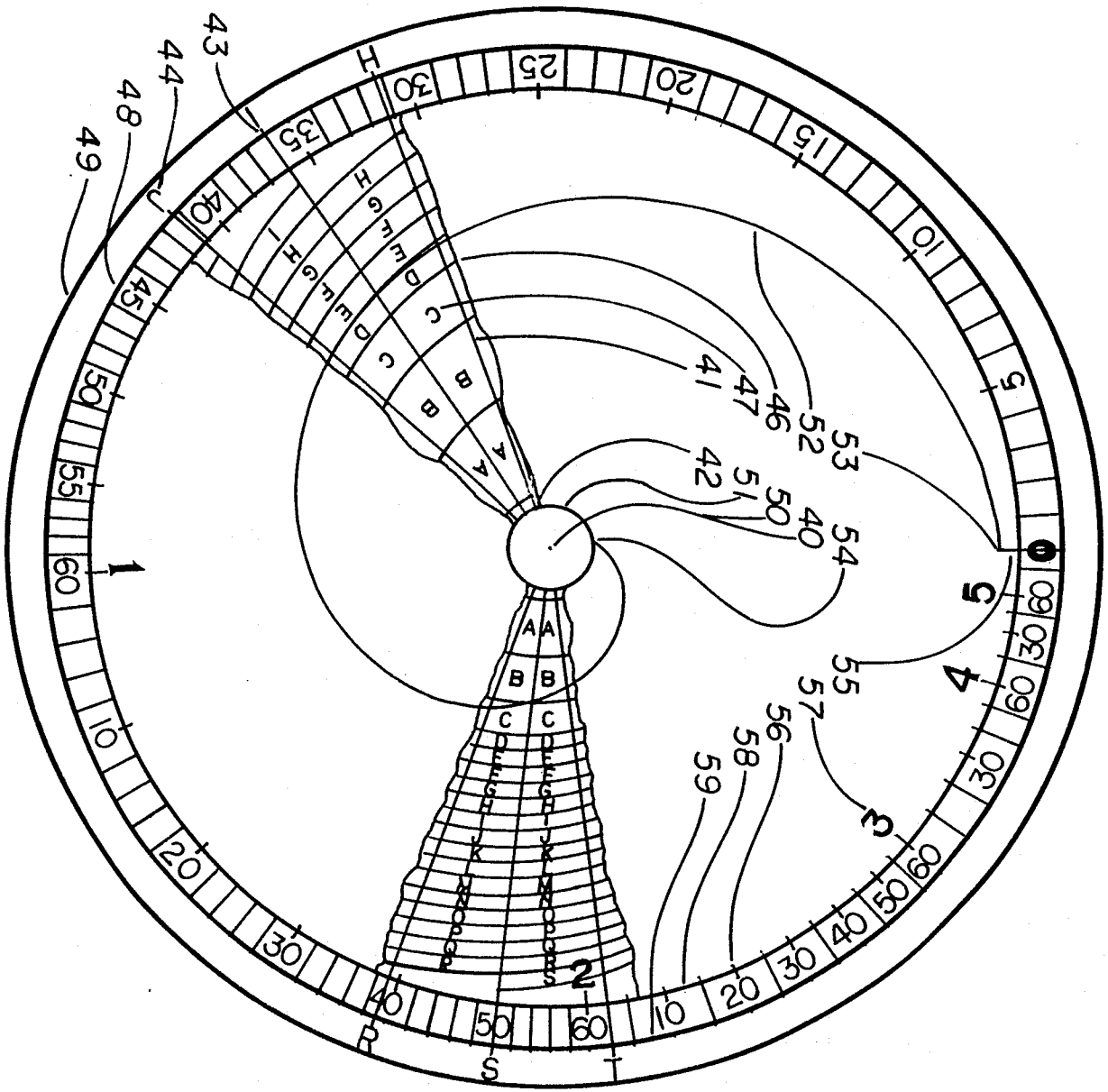
FIG. 7 is a cutaway view of the reverse side of the diving computer of the present invention, showing the rear rotor bearing the inscriptions of FIG. 5 and portions of the rear surface of the base bearing the inscriptions of FIGS. 4 and 4A assembled to demonstrate the performance of a calculation.

There are shown in FIGS. 1 through 5 the component parts of a slide rule for calculating pressures within body tissues, in FIGS. 6 and 7, the embodiment of said components assembled to demonstrate the performance of calculations, and in FIG. 8, a cross-sectional view of said embodiment.

The front face 1 of the base 6 is shown in FIG. 1. Curved lines 12 inscribed on front face 1 correspond to a plurality of defined constant depths, with the given depth value corresponding to a particular curve being identified by the reference numeral 13. Each of the curved lines 12 represents a graphic solution of the Haldane equation for a particular constant depth. Said curves 12 represent how pressure in the 60 minute half-time tissue changes at said depths with respect to time. The shortest and straightest curve 12 represents a depth of 140 feet, and each subsequent curve 12 may preferably represent a depth in increments of −10 feet through 100 feet and increments of −5 feet from 100 feet through 35 feet. Each curve 12 is marked one or more times by reference numeral 13 to be easily identifiable. Front face 1 is plotted in polar format, using polar coordinates, with the radial coordinate representing tissue pressure and the angular coordinate representing time.

Tissue pressures are plotted linearly as radial coordinates on front face 1 and represent pressure in FSWA, said pressures being defined as equal to atmospheric pressure at their beginning point on center circle 11 and equal to slightly greater than the maximum permissible pressure in the 60 minute half-time tissue at the inner peripheral circle 18. Thus the scale of pressure along a radius between these two circles ranges from 33 FSWA to about 66 FSWA.

Time, or T, is the linear angular coordinate on front face 1 and may preferably represent the mathematical relationship that 1 minute of time is equivalent to 1.6 degrees of arc. The scale of time ranges from T=0 to T=225, or somewhat in excess of the amount of time required to reach the no-decompression limit at 35 feet, the shallowest depth displayed and the depth with the greatest no-decompression limit, said time scale equivalency encompassing the entire circumference of the circle. Time indicia are not inscribed on front face 1 but are implicit in the trigonometric construction of the preferred embodiment.

The curves 12 shown on front face 1 begin on the center circle 11 at intervals of 12.5 degrees. This arbitrary interval was chosen to provide maximum readability and minimum visual confusion; alternative embodiments using a lesser or greater number of curves may be used. Each curve 12 is plotted from T=0 to T=the no-decompression limit for that depth, and each curve 12 is intersected by a portion of a radius 14 at a point where T=no-decompression limit. In addition, each curve 12 representing a depth of 80–40 feet is intersected by a portion of a radius 15 at a point where T="multi-level limit", defined as being a time limit similar to but less than the no-decompression limit for a given depth, for use when a diver has operated at a previous and greater depth within the same dive. A curve 36 connecting the points where radii 14 intersect depth curves 12 serves as the inner border of a zone 39 created between said curve 36 and a curve 37 which is a curve drawn radially parallel to said curve 36 and which has a radius somewhat greater than said curve 36. Said zone 39 preferably may be distinctively colored to provide visual warning of danger. A curve 35 connecting the points where radii 15 intersect depth curves 12 serves as the inner border of a zone 38 created between said curve 35 and said curve 36. Said zone 38 preferably may be distinctively colored to provide visual warning of danger, and with the color of zone 38 contrasting with the color of zone 39.

An outer peripheral circle 19 provides a border for front face 1 and between said circle 19 and inner peripheral circle 18 are disposed initial depth indicia 16 which are aligned with initial depth alignment marks 17, each of said marks 17 being a portion of a radius passing through the intersection of a depth curve 12 and center circle 11 and extending peripherally as a short length beginning at the intersection of said radius and inner peripheral circle 18, said initial depth values 16 being equal to the corresponding depth reference numerals 13 of curves 12, and which provide accurate reference points to begin the operation of the calculator as will be described later. If the preferred embodiment were to be based on the metric system, front face 1 is the only component of the invention that would require conversion.

Figure 2:
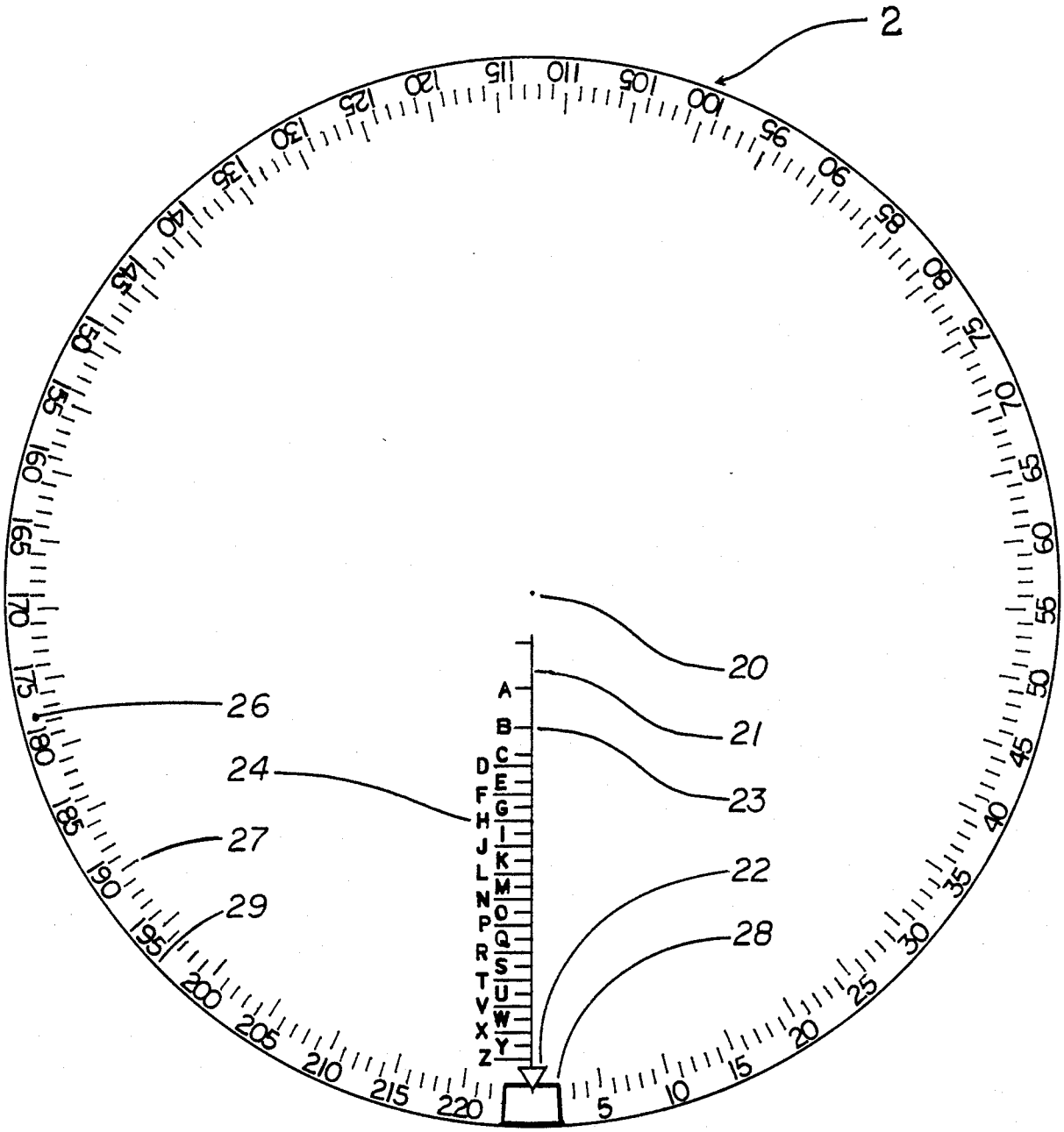
FIG. 2 shows the inscriptions on the rotatable front rotor of the diving computer of the present invention.

The front rotor 2 is shown in FIG. 2. Front rotor 2 is plotted in polar format using polar coordinates, and is rotatably associated with front face 1. Front rotor 2 is a transparent circular disc having a center of rotation 20 coincident with the center 10 of front face 1 and having inscribed thereon a single radius 21, said radius having disposed at right angles thereto a series of spaced markings 23, preferably twenty-six of such markings identified by the letters A–Z, although any suitable indicia may be used, said alphabetical indicia being identified by reference numerals 24. These alphabetical indicia correspond to certain arbitrarily defined tissue pressure ranges, namely:

A=Range from 33.5–37 FSWA
B=Range from 37–40 FSWA
C=Range from 40–42 FSWA
D=Range from 42–43 FSWA
. . . increasing by 1 FSWA/letter of the alphabet until . . .
Z=Range from 64–65 FSWA The numerical values of said pressure ranges are linear in scale, but the definition causes the ranges of the letters "A", "B" and "C", to be larger than those of the remaining letters, hence the spacing of said first three indicia 24 on the radius 21 is greater than the others. Said radius 21 extends from a beginning point as distant from center 20 as the length of the radius of center circle 11 of front face 1, to a terminus end 22 which also serves as a pointer for indicating one of a plurality of initial depth values 16 inscribed on the front face 1 of the invention, as shown in FIGS. 1 and 6, said initial depth value 16 representing the depth of water to which a diver descends for his first exposure. Front rotor 2 has a peripheral circle 29, and an opaque peripheral outer boundary 26 which has dimensions so that said opaque boundary 26 overlies and obscures the area between the peripheral circles 18 and 19 of front face 1, except for a small area visible through a transparent opening 28 disposed within said opaque boundary 26 and coinciding with pointer 22 so that a user of the invention may view a given initial depth value 16 of front face 1 being indicated by pointer 22 without being distracted by adjacent depth values 16. Inscribed upon said opaque boundary 26 are time scale indicia 27 previously referred to as being the angular coordinates of front face 1. Said time scale is represented in minutes, spans 225 minutes or sufficient for the longest of the relevant dives, and encompasses the entire circumference of front rotor 2.

Figure 3:
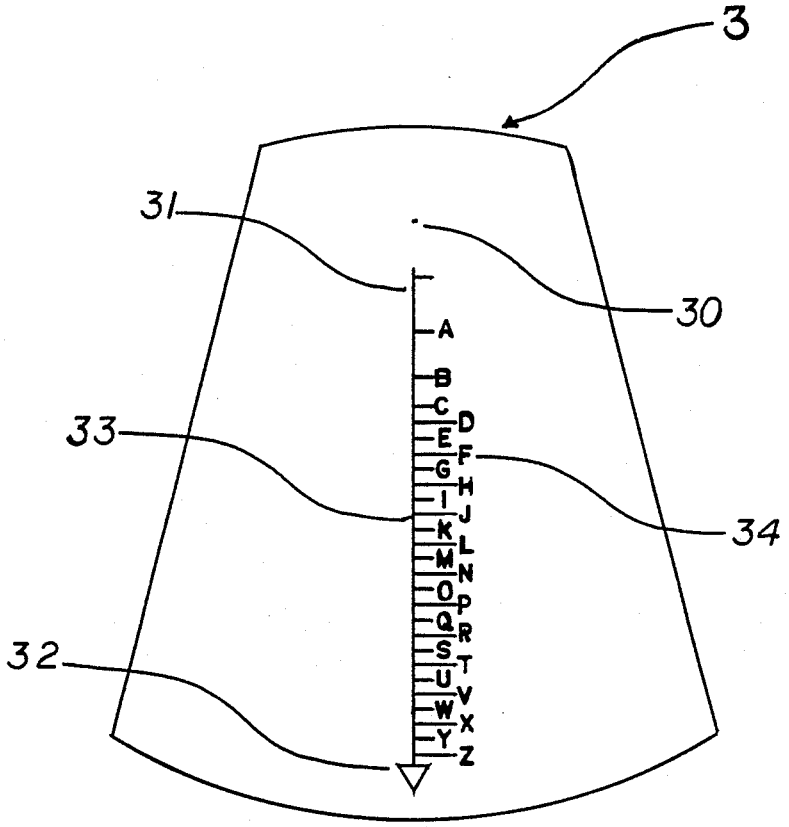
FIG. 3 shows the inscriptions on the cursor of the diving computer of the present invention.

The cursor 3 is shown in FIG. 3. Cursor 3 is rotatably disposed upon front rotor 2 and is a portion of a transparent circular disc having a center of rotation 30 coincident with the center 20 of front rotor 2, and is rotatable about center 20 of front rotor 2. A radius 31 nearly identical to radius 21 of front rotor 2 is disposed thereon, said radius 31 having the same dimensions as its counterpart radius 21 of front rotor 2, and having a pointer 32 which is the same as the pointer 22 of said radius 21, the only differences between said radii being that the spaced markings 33 and alphabetical indicia 34 of cursor 3 are aligned in the opposite direction from their counterparts 23 and 24 of front rotor 2, so that if it is necessary to operate front rotor 2 and cursor 3 in the close proximity of a short time span, visual confusion will be minimized. The radius 31 of cursor 3 represents precisely the same tissue pressure scale as the radius 21 of front rotor 2.

Figure 4A:
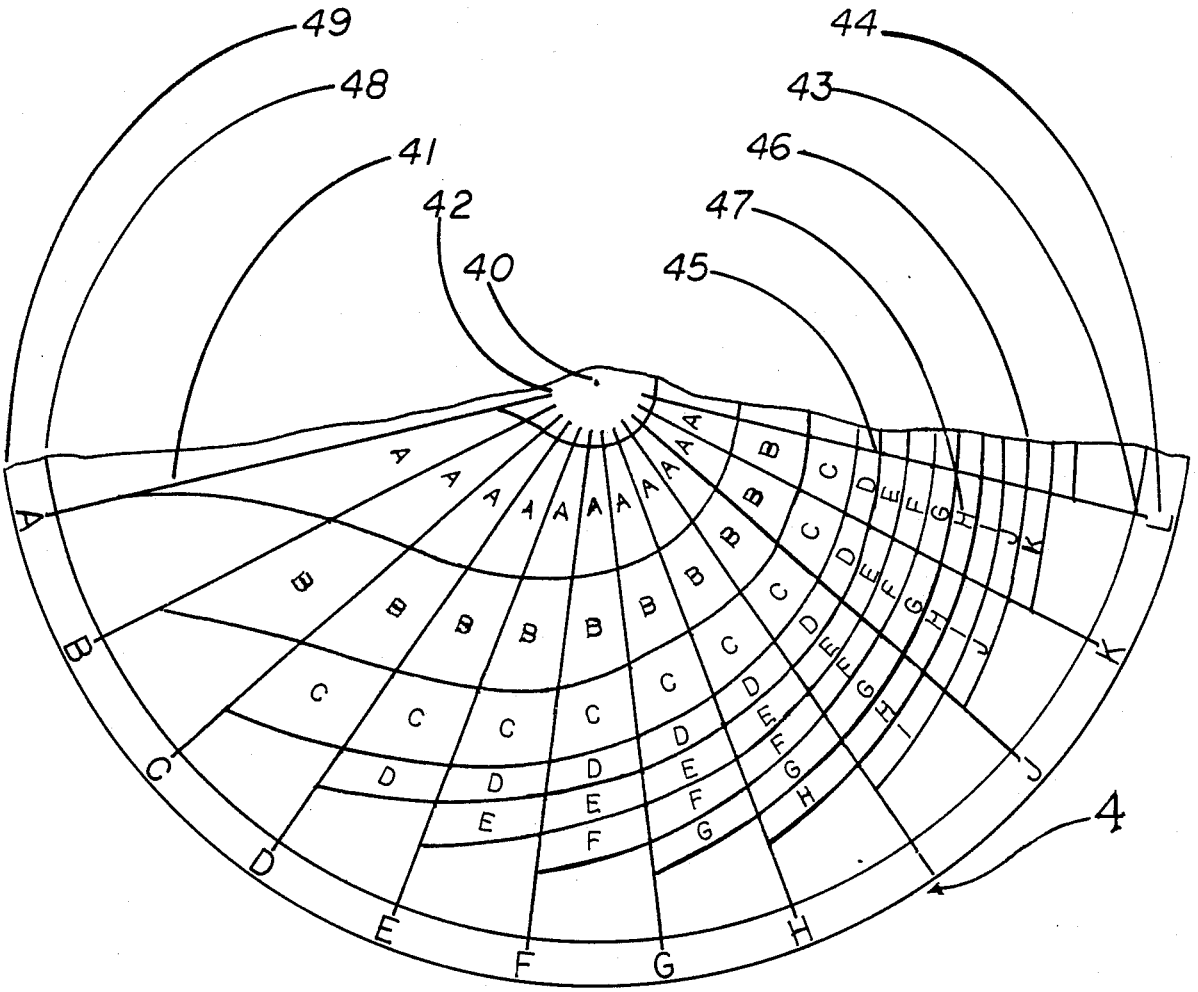
FIG. 4A shows another portion of the inscriptions on the rear surface of the base of the diving computer of the present invention.

The rear face 4 of the base is shown in FIGS. 4 and 4A. It is difficult to show every element of said face 4 in a single black and white line drawing; accordingly, FIG. 4 shows the more fundamental aspects of said face 4 and FIG. 4A shows additional aspects of said face 4.

FIG. 4 has inscribed thereon a plurality of pressure scale radii 41, each of said radii 41 being one of twenty-six and having a central end 42 beginning at a distance from center 40 equal to the radius of center circle 51 of rear rotor 5 as shown in FIG. 5, extending to a peripheral end 43, and having a radial length slightly greater than the radius of inner peripheral circle 48. Each radius 41 has associated therewith at its peripheral end 43 a pressure range indicium, said indicium being identified by reference numeral 44. Each of the indicia 44 is one of the alphabetical sequence A–Z and represents a magnitude of tissue pressure, identically as set forth in the description of radius 21 of front rotor 2, with "A" being the least, and "Z" being the greatest. Rear face 4 is bordered by an inner peripheral circle 48 and an outer peripheral circle 49 which are concentric with center 40 and which provide an area for the disposition of said reference letters 44.

Said plurality of radii 41 are evenly spaced around the center 40 of said rear face 4 and correspond to tissue pressures of varying magnitudes. The radii 41 are plotted in polar format, using polar coordinates. The radial coordinate represents tissue pressure wherein the central end 42 of each radius equates to 33 FSWA, or atmospheric pressure. Each radius 41 is intersected by a line 45 near its peripheral end equidistant from the center 40, which represents the pressure denoted by the associated pressure range indicium 44.

The scale of pressures along the radii 41 is linear, and is different for each radius. Each letter in the alphabet equates (in most cases) to a range of pressure of 1 FSWA, the exceptions being A through C which represent increments greater than 1 FSWA. The lengths of each radius 41 are identical, but each represents an ever greater tissue pressure as the alphabetical sequence is followed from the first radius 41 denoted by corresponding letter A counterclockwise around rear face 4. The absolute value of a given tissue pressure as designated by a letter, e.g. "M", is always the same, regardless of the magnitude of the initial tissue pressure and regardless of its position on any given radius.

Each radius 41 is marked by a series of lines 45 that intersect said radius 41, the number in the series being one greater than the numerical value of the letter designator 44 of said radius 41. To illustrate: A is letter #1; 1+1=2, the number of lines 45 that intersect the A radius, and E is letter #5; 5+1=6, the number of lines 45 that intersect the E radius, and so on. The outermost line of intersection 45 of each radius 41 represents the maximum tissue pressure for that particular pressure range, as designated by the numeral 44 at the end of said radius 41. The next line 45 toward the center 40 represents the maximum tissue pressure of the next lower pressure range as designated by the next lower letter in the alphabet from said designator 44, and so on until the most central line 45 is reached at which time the body is deemed to have no residual nitrogen pressure. Thus, while the absolute value of a given pressure is always the same, its position on the various radii 41 moves ever closer to the center of the circle 40 as the radii 41 progress through the alphabet reference numerals 44.

FIG. 4A is a portion of the rear face of FIG. 4 and shows the inscriptions on said portion of said face. If a curve is drawn through the point on each successive radius 41 where the line 45 marking the lower end of pressure range A intersects said radii 41, and another curve is drawn through each line of intersection 45 marking the lower end of pressure range B, and so on through letter Z, a series of spirals appear. These spirals are isobars 46 representing ranges of equal tissue pressure, and are designated alphabetically by their corresponding isobaric indicia 47 disposed between said isobars 46 and the radii 41. While the pressure differential between any two given pressure ranges marked by the same isobaric indicia 47 is the same, the radial length corresponding to any such differential is different for each radius 41.

The rear rotor 5 is shown in FIG. 5. Rear rotor 5 is rotatably associated with rear face 4 and is a transparent circular disc having a center of rotation 50 coincident with the center 40 of rear face 4. A center circle 51 concentric with center 50 is inscribed on said rotor 5, representing 33 FSWA atmospheric pressure, said circle 51 having a radius equal to the distance from center 40 of rear face 4 and the beginning points of radii 41. Rear rotor 5 has an outer peripheral circle 59 and an inner peripheral circle 58, both of said circles being concentric with center 50. Outer circle 59 has a radius equal to that of inner circle 48 of rear face 4. Inner circle 58 of rear rotor 5 has a radius less than the radius of outer circle 59 of rear face 5 by an amount equal to the difference of the radial length of circles 48 and 49 of rear face 4.

A generally helical curve 52 representing solutions in polar format to the Haldane equation is inscribed on rear rotor 5, having a generally peripheral beginning point 53 located near inner circle 58 and the zero time-scale indicia point 55 found on inner circle 58 of said rear rotor 5, and an ending point 54 on center circle 51, said helical curve 52 passing through a 360 degree rotation clockwise when going from beginning point 53 to ending point 54. The rear rotor is plotted in polar format with tissue pressure being represented linearly as the radial coordinate.

As before, the angular coordinate represents time, with the time scale indicia 56 being inscribed about the periphery of rear rotor 5 between inner circle 58 and outer circle 59 and spanning the range of 0 to 360 minutes, or six halftimes. (As a rule of thumb, tissue pressure is considered to be essentially in equilibrium with ambient pressure at the end of six halftimes; the actual figure is 98.4% of equilibration, but typically, the process is deemed to be complete.)

There is a significant difference between the front and rear sides of the instant invention: on the front side, the time scale is linear and on the rear side, it is exponential. A non-linear time scale enlarged toward the minimum-time end and diminished toward the maximum-time end improveds accuracy, discrimination and readability where they matter most, and sacrifices these qualities somewhat where they matter least, because (1) the significance of pressure change is far more critical for short times at the surface, and (2) most divers would seldom use the invention on those occasions when large amounts of time are spent at the surface. This logic applies equally to the front side, but the front side simply could not function as intended if its time scale were non-linear.

Non-linearity may be achieved by a number of mathematical conventions, including tangential, logarithmic, and exponential; all would function adequately. However, my experiences have demonstrated that the best method is to use an exponential relationship because the Haldane equation itself is exponential. The use of a exponential time scale means that time spent on the surface is represented by an angular coordinate which subtends progressively smaller angles ($\theta$ or theta) of a circle in an exponential relationship as the radial coordinate of tissue pressure diminishes in a linear relationship in accordance with the function $$\theta=[(6H)(1-2^{-T/H})(P-N)]/(M-Z)$$

where:

H=tissue halftime
T=time in minutes
P=surfacing tissue pressure

N=ambient pressure at surface

M=maximum allowable tissue pressure

Z=pressure in tissue at end of six halftimes

Having used this equation to determine the values of the time scale of rear rotor 5, the helical curve 52 of rear rotor 5 was generated by correlating (a) the defined linear tissue pressures of the radial coordinate of the Z radius 41 of rear face 4, (b) the number of minutes required for pressure beginning in the Z pressure range to diminish to each lower pressure range, as determined by the calculations of a variation of the Haldane equation, $$T=H \log [(Q-N)/(P-N]/\log 0.5$$

where Q=tissue pressure and other terms are as in prior paragraph, and (c) the angular coordinate ($\theta$) that corresponded to these amounts of time. The rear rotor 5, now consisted of a time scale, as represented by time scale indicia 56, and a helical curve 52, and was employed sequentially on the remaining radii 41 of rear face 4 to fix on said radii 41 the positions of the lines of intersection 45 marking the points where tissue pressures would correspond with times spent at the surface as indicated by the helical curve 52 of rear rotor 5.

Thus 60 minutes encompass (approximately) $\frac{1}{2}$ of the circumference, 120 minutes $\frac{3}{4}$ thereof, 180 minutes $\frac{7}{8}$, and so on. The time scale indicia 56 may preferably be marked at the periphery of rear rotor 5 as follows:

1. One minute intervals for the first 60 minutes, with numbers at 5 minute intervals;
2. Two minute intervals for 60–120 minutes, with numbers at 10 minute intervals;
3. Five minute intervals for 120–180 minutes, with numbers at 10 minute intervals;
4. Ten minute intervals for 180–240 minutes, with numbers at 30 minute intervals;
5. Fifteen minute intervals for 240–300 minutes, with numbers at 30 minute intervals,
6. Thirty minute intervals for 300–360.

Each hour may also be numbered at the appropriate point just inside the inner circle 58 of rear rotor 5 using hourly indicia 57 for easier readability. Time scales of greater or lesser duration are contemplated which may be appropriate for use in calculating pressures in other than the 60 minute halftime tissue.

FIG. 6 shows FIGS. 1, 2, and 3 assembled to demonstrate the performance of a calculation. As drawn, FIG. 6 includes FIG. 3 bounded by dashed lines and superimposed on FIG. 2 (in its entirety), which in turn is superimposed on a portion of FIG. 1, namely, the depth curves 12 corresponding to 60–45 feet with the associated moieties of no-decompression and multi-level limit curves and bands 35, 36, 37, 38, and 39, as well as the peripheral initial depth indicium 16 corresponding to 50 feet, said indicium 16 appearing in transparent opening 28. The practical applications illustrated by FIG. 6 will be discussed in detail in the section which follows the explanation of operation of the instant invention.

FIG. 7 shows FIGS. 4, 4A, and 5 assembled to demonstrate the performance of a calculation. As drawn, FIG. 7 includes FIG. 5 (in its entirety) superimposed on portions of FIGS. 4 and 4A, namely, the radii 41 including the central ends 42 and peripheral ends 43 of said radii 41 corresponding to pressure groups H–J and R–T, with the associated moieties of pressure indicia 44, isobars 46, and isobaric indicia 47, as well as peripheral circles 48 and 49. The practical applications illustrated by FIG. 7 will be discussed in detail in the section which follows the explanation of operation of the instant invention.

FIG. 8 is a cross-sectional view of the invention comprised of cursor 3, front rotor 2, planar base member 6 (which is inscribed on its upper surface with front face 1 and on its lower surface with rear face 4), rear rotor 5, and axis of rotation 7. The specifics of assembly have been previously described. The cursor 3, front rotor 2, and rear rotor 5 are connected by a pin means of rotation inserted through holes in their centers.

OPERATIONAL METHODOLOGY

The instant invention provides a convenient, rapid and novel means of calculating accumulated tissue pressure by the use of the following procedures:

(1) Determine the maximum permissible time limit (hereafter MPTL) for the depth of the dive (in an example that will be continued, 100 feet) by aligning window 28 and pointer 22 of radius 21 of front rotor 2 with the 100 foot depth indicium 16 of front face 1. The window 28 is not used again in a day's diving. Align radius 31 of cursor 3 with the no-decompression limit mark 14 on the 100 foot curve 12 designated by a reference numeral 13 on front face 1; pointer 32 of radius 31 of cursor 3 will point to a time scale indicium 27, in this example the number 20, meaning that for an initial dive to 100 feet, the MPTL is 20 minutes.

(2) Determine the tissue pressure that develops by aligning said radius 31 with the actual time of the dive as located on the time scale (e.g., 15 minutes). Said radius 31 intersects said 100 foot curve 12 between spaced markings 23 that correspond to pressure range indicia 24 denoted as I and J (hereafter referred to as pressure group, or more simply as PG), indicating that the PG is greater than I but not as great as J, hence the PG of this example is J when the diver reaches the surface (when there is a choice between two letters, the convention is to select the greater of the two), and this value is the entering argument for the rear side. The period commonly called the surface interval (the time spent at the surface) begins at the moment of surfacing and ends at the moment of redescending.

(3) Determine the decrease in tissue pressure during the surface interval by turning to the rear side of the invention and selecting the radius 41 that is marked at its peripheral end 43 by a pressure indicium 44 that is the same as the entering argument as determined by operation of the front side (e.g., the radius with J at its outer end). Rotate the rear rotor 5 until the time of the surface interval (e.g., 39 minutes) as represented by time scale indicium 56 of rear rotor 5 is aligned in superimposition with radius J. Helical curve 52 of rear rotor 5 will intersect radius J at a point between the lines of intersection 45 on radius J marked with isobaric indicia 47 which correspond to PG E and PG D, thereby indicating that the residual pressure is less than E, but greater than D hence the PG of this example is E when the diver redescends, and this value is used as an entering argument on the front side when the diver begins a subsequent dive.

(4) Determine the MPTL for the subsequent dive by aligning a preselected depth curve 12 (e.g., 60 feet) with the point on radius 21 of front rotor 2 that corresponds to PG E (this is the entering argument for the front side as determined by operation of the rear side; performing this step allows for the accumulation of nitrogen in the tissues), and then aligning pojinter 32 of cursor 3 with the NDL mark 14 on said 60 foot curve. Said pointer will indicate 37 minutes on the time scale, the MPTL for said subsequent dive.

(5) From this point forward, steps are repeated in the sequence of step 2, step 3, step 4, and again for as long as the diver continues activity.

(6) In order to engage in multi-level diving, or operating at more than one level within a single dive, only slight procedural modification is required. Calculate the pressure in the tissues from the first level (whether on the first dive or a later one) as described in step 2. On ascending to a lesser depth, the final PG of the prior level is the beginning PG of the next level. To elaborate, if a diver had been at 90 feet for 25 minutes and chose to ascend to 55 feet, he would determine by step 2 that his PG was Q at the end of the 90 foot exposure. He would then align PG Q of radius 21 with the 55 foot depth curve 12 and determine his new MPTL for this new depth by aligning radius 31 with the multi-level limit mark 15, not the no-decompression limit mark 14 as done previously, and read the MPTL of 9 minutes. (The multi-level limit is analogous to the no-decompression limit but is smaller and represents an additional restriction on MPTL for a diver who chooses to do multi-level diving, and it was calculated by Haldanian methods to deal with tissues whose halftimes are less than 60 minutes and which reach their limits in multi-level diving sooner than does the 60 minute tissue.)

(7) When a diver chooses to ascend to the surface, step 2 is performed, and the rest of the sequence is as previously described.

(8) If the diver chooses to operate at yet a shallower level, as for example 35 feet, steps 6 and 7 are repeated.

Operation of the instant invention having been explained, it is possible to discuss the practical applications illustrated by FIGS. 6 and 7.

Several circumstances are illustrated by FIG. 6.

(1) If the dive is the first of the day: For a dive to a depth of 50 feet, front rotor 2 is rotated over front face 1 so that the transparent opening 28 is superimposed over initial depth indicium 16 corresponding to said depth of dive. Cursor 3 is rotated so that pointer 32 points to the time scale indicium 27 which corresponds to the time of the dive, in this example, 56 minutes. The pressure status of the diver is determined by noting the pressure scale indicia 34 on radius 31 of cursor 3 at the point of intersection with depth curve 12 bearing reference numeral 13 that corresponds to said depth of dive. Said curve 12 intersects said radius 31 at a point between said indicia 34 corresponding to PG Q and PG R, indicating that the diver should be considered to be in PG R, the greater of the two pressure groups.

(2) If the dive is subsequent to an earlier dive and surface interval wherein the diver descended in PG D: if said diver descended to 60 feet and stayed for the indicated time of 56 minutes, said diver would be seriously in excess of the MPTL of approximately 39 minutes, the time with which the no-decompression limit mark 14 of the "60 foot" curve 12 aligns.

(3) If the dive is subsequent to an earlier dive and surface interval wherein the diver descended in PG A: if said diver descended to 55 feet and stayed for the indicated time of 56 minutes, said diver would be very close to the no-decompression limit for such a repetitive dive and would determine the surfacing PG to be W.

(4) If the diver had been to a deeper level for a short time, had determined the final PG for that exposure to be D, and chose to ascend to 60 feet for a time: Said diver would align PG D of radius 21 as shown and note cursor 3 to be misaligned for the desired MPTL determination. Cursor 3 would require clockwise rotation to perform its purpose (and the same is true for a diver whose PG is A on ascending to 55 feet; cursor 3 is presently aligned past the multi-level limit mark 15 for the "55 foot" curve and would require reorientation).

Several circumstances are illustrated by FIG. 7.

(1) If a diver had surfaced in PG I and had been at the surface for 36 minutes, the new PG would be determined by rotating rear rotor 5 so that time scale indicium 56 corresponding to 36 minutes is aligned with initial pressure indicium 44 at the peripheral end 43 of radius 41 corresponding to PG I. Helical curve 52 intersects said radius 41 at a point where the isobar 46 corresponding to PG D also intersects said radius 41. Accordingly, since there is a choice between two pressure groups, the greater (PG E) is chosen.

(2) If a diver had surfaced i PG S and had been at the surface for one hour and 50 minutes, the new PG would be determined to be PG C, using the procedure of the previous example.

Additionally, the instant invention has been described as having a planar base member that is circular, but said member is not limited to said shape, any shape being suitable that is practical in presenting information that may be valuable to the user but not essential to the operation of said invention. Further, the liberal use of carefully chosen colors will facilitate the ease and accuracy of operation by directing the user's eye and simplifying the user's visual perception.

While the instant invention has been shown and described in what is considered to be the most practical and preferred of embodiments, it is understood that this is for purposes of illustration rather than limitation, and that this invention is capable of extended application, and is not confined to the precise disclosure. Changes and modifications may be made by one skilled in the art that do not affect the spirit of the invention, nor exceed the scope thereof, as expressed in the appended claims.

What is claimed is:

1. A dive planning computer for computing a maximum time interval for which an underwater diver can remain submersed at a given depth without having to undergo decompression, comprising:

a planar member having an obverse face;

a polar graph inscribed on said obverse face of said planar member and having a center, angular coordinates, and radial coordinates, said polar graph relating pressure in body tissues of the diver resulting from exposure to hydrostatic pressure to depth and exposure time, said angular coordinates of said polar graph representing intervals of time, said radial coordinates representing tissue pressure, and each one of a plurality of depths being represented by one of a plurality of curved depth lines comprising a series of points on said polar graph relating exposure time and tissue pressures at each of said depths, each one of said curved depth lines having a limit point marked thereon at one of said angular coordinates corresponding to said maximum time interval for which the diver can remain submersed at a depth corresponding to said one of said curved depth lines without having to undergo decompression, and said planar member further having a plurality of depth indicia inscribed on said obverse face thereof, each of said plurality of depth indicia being disposed at angular coordinates calibrated with a corresponding one of said curved depth lines;

a rotor superimposed on said obverse face of said planar member and mounted for rotation with respect thereto about an axis of rotation coincident with said center of said polar graph, said rotor having an indicator thereon such that said rotor is selectively rotatable to align said indicator with a desired one of said depth indicia on said obverse face of said planar member, and said rotor having a time scale with corresponding time indica thereon, said time scale being calibrated to said angular coordinates of said polar graph on said obverse face of said planar member; and a cursor superimposed on said rotor and mounted for rotation with respect to said rotor and said planar member about an axis of rotation coincident with said axis of rotation of said rotor, said cursor having a crosshair thereon for relating each point on each of said curved depth lines on said polar graph on said obverse face of said planar member with one of said time indicia on said rotor, said cursor being selectively rotatable to align said crosshair with a desired point on a desired curved depth line on said polar graph on said obverse face of said planar member;

whereby by rotating said rotor to align said indicator on said rotor with one of said plurality of depth indicia on said obverse face of said planar member corresponding to a desired diving depth, said time indicia on said rotor are aligned with one of said curved depth lines corresponding to said desired diving depth; and whereby by rotating said cursor to align said crosshair with said limit point on said one of said curved depth lines corresponding to said desired diving depth, said crosshair on said cursor will relate said limit point to one of said time indicia on said rotor, which one of said time indicia corresponds to the maximum time interval for which the diver can remain submersed at said desired diving depth without having to undergo decompression.

2. The dive planning computer of claim 1, further comprising a line connecting said limit points on said curved depth lines, whereby said limit points are more easily visualized.

3. A dive planning computer for computing the maximum time for which an underwater diver, after remaining submersed at a first depth for a first time period, can remain submersed at a second depth without having to undergo decompression, comprising:

a planar member having obverse and reverse faces, a polar graph inscribed on said obverse face of said planar member and having a center, angular coordinates, and radial coordinates, said polar graph relating pressure in body tissues of the diver resulting from exposure to hydrostatic pressure to depth and exposure time, said angular coordinates of said polar graph representing intervals of time, said radial coordinates representing tissue pressure, and each one of a plurality of depths being represented by one of a plurality of curved depth lines comprising a series of points on said polar graph relating exposure time and tissue pressures at each of said depths, each one of said curved depth lines having a limit point marked thereon at one of said angular coordinates corresponding to said maximum time interval for which the diver can remain submersed at a depth corresponding to said one of said curved depth lines without having to undergo decompression, and said planar member further having a plurality of depth indicia inscribed on said obverse face thereof, each of said plurality of depth indicia being disposed at angular coordinates calibrated with a corresponding one of said curved depth lines;

a rotor superimposed on said obverse face of said planar member and mounted for rotation with respect thereto about in axis of rotationn coincident with said center of said polar graph, said rotor having an indicator thereon such that said rotor is selectively to align said indicator with a desired one of said depth indica on said polar graph, said rotor having a pressure group scale thereon marked in radial increments, and said rotor having a time scale with corresponding time indicia thereon, said time scale being calibrated to said angular coordinates of said polar graph on said obverse face of said planar member; and a cursor superimposed on said rotor and mounted for rotation with respect to said rotor and said planar member about an axis of rotation coincident with said axis of rotation of said rotor, said cursor having a crosshair thereon for relating each point on each of said curved depth lines on said polar graph on said obverse face of said planar member with a corresponding time indicium on said rotor, said cursor being selectively to align said crosshair with a desired one of said time indicia on said rotor or to align said crosshair with a desired point on a desired one of said plurality of curved depth lines on said polar graph on said obverse face of said planar member, and said cursor further having a pressure group scale thereon marked in radial increments, each radial increment on said pressure group scale on said cursor corresponding to a radial increment on said pressure group scale on said rotor;

whereby a user can compute the maximum time interval for which a diver, after being submersed at a first depth for a first time interval, can remain submersed at a second path without having to undergo decompression by manipulating said dive planning computer as follows:

(a) rotating said rotor to align said indicator on said rotor with the one of said depth indicia on said polar graph corresponding to said first diving depth;

(b) rotating said cursor to align said crosshair with a one of said time indicia on said rotor corresponding to said first time interval, said crosshair thereby intersecting the one of said plurality of curved depth lines corresponding to said first depth at a radial increment on said pressure group scale on said cursor;

(c) said radial increment of said pressure group scale which intersects said one of said plurality of curved depth lines corresponding to said first depth to identify a radial increment on said pressure group scale on said rotor;

(d) rotating said rotor until said identical radial increment on said pressure group scale on said rotor intersects a one of said plurality of curved depth lines corresponding to said second depth; and (e) rotating said cursor until said crosshair is aligned with the limit point on said one of said plurality of curved depth lines corresponding to said second depth, said crosshair thereby relating the limit point on said one of said plurality of curved depth lines corresponding to said second depth to one of said plurality of time indicia on said rotor, which one of said time indicia corresponds to the maximum time for which the diver can remain submersed at said second depth without having to undergo decompression.

4. The dive planning computer of claim 3, further comprising:

a pressure group indicium associated with each of said radial increments on said pressure group scale on said cursor; and a pressure group indicium associated with each of said radial increments of said pressure group scale on said rotor, the pressure group indicium associated with a given radial increment on said pressure group scale on said rotor corresponding to the pressure group indicium associated with a corresponding radial increment on said pressure group scale on said cursor;

whereby the radial increment on said pressure group scale on said rotor corresponding to a radial increment on said pressure group scale on said cursor is easily identified by locating the radial increment on said rotor which has a pressure group indicium corresponding to the pressure group indicium of the corresponding radial increment on said cursor.

5. A dive planning computer for underwater divers, comprising:

a planar member having obverse and reverse faces;

a first polar graph inscribed on said obverse face of said planar member and having a center, angular coordinates, and radial coordinates, said first polar graph relating pressure in body tissues of a diver resulting from exposure to hydrostatic pressure to depth and exposure time, said angular coordinates of said first polar graph representing time, said radial coordinates representing tissue pressure, and each one of a plurality of depths being represented by one of a plurality of curved depth lines comprising a series of points on said first polar graph relating exposure time and tissue pressures at each of said depths, each one of said curved depth lines having a limit point marked thereon at one of said angular coordinates corresponding to the maximum time interval for which the diver can remain submersed at a depth corresponding to said one of said curved depth lines without having to undergo decompression, and said first polar graph further having a plurality of depth indicia inscribed thereon, each of said plurality of depth indicia being disposed at angular coordinates calibrated with a corresponding one of said curved depth lines;

a front rotor superimposed on said obverse face of said planar member and mounted for rotation with respect thereto about an axis of rotation coincident with said center of said first polar graph, said front rotor having an indicator thereon such that said front rotor is selectively rotatable to align said indicator with a desired one of said depth indicia on said first polar graph, said front rotor having a pressure group scale thereon marked in radial increments, and said front rotor having a time scale in angular coordinates with corresponding time indicia thereon, said time scale being calibrated to said angular coordinates of said first polar graph;

a cursor superimposed on said front rotor and mounted for rotation with respect to said front rotor and said planar member about an axis of rotation coincident with said axis of rotation of said front rotor, said cursor having a crosshair thereon for relating each point on each of said curved depth lines on said first polar graph on said obverse face of said planar member with a corresponding one of said time indicia on said front rotor, said cursor being selectively rotatable to align said crosshair with a desired one of said time indicia on said front rotor or to align said crosshair with a desired point on a desired depth line on said first polar graph on said obverse face of said planar member, and said cursor further having a pressure group scale thereon marked in radial increments;

a second polar graph inscribed on the reverse face of said planar member concentric with said first polar graph on said obverse face, said second polar graph having a plurality of radial pressure scales inscribed thereon representing tissue pressures, said radial pressure scales being marked in radial increments of pressure, each of said radial pressure scales corresponding to one of said radial increments on said pressure group scale on said said cursor, and each of said increments on each of said radial pressure scales corresponding to one of said radial increments on said pressure group scale on said front rotor;

a rear rotor superimposed on said reverse face of said planar member and mounted for rotation with respect thereto about an axis of rotation coincident with said axis of rotation of said front rotor, said rear rotor having inscribed thereon a third polar graph having angular coordinates and radial coordinates wherein said radial coordinates represent tissue pressure, said angular coordinates represent time, and pressure in the body tissue of the diver at a given time interval following a dive is plotted on said second polar graph as a generally helical line, and said rear rotor further having a time scale inscribed thereon with corresponding time indicia and calibrated with said angular coordinates of said third polar graph;

whereby a user can compute the maximum time interval for which the diver, after being submersed at a first depth for a first time interval, and after remaining surfaced for a sequential second time interval, can remain submersed at a second depth without having to undergo decompression by manipulating said dive planning computer as follows:

(a) rotating said front rotor to align said indicator on said front rotor with one of said depth indicia on said first polar graph corresponding to said first diving depth;

(b) rotating said cursor to align said crosshair with one of said time indicia on said front rotor corresponding to said first time interval, said crosshair thereby intersecting one of said curved depth lines corresponding to said first depth at a radial increment on said pressure group scale on said cursor;

(c) using the intersecting radial increment on said crosshair to identify one of said radial pressure scales on said second polar graph on said rear face of said planar member;

(d) rotating said rear rotor to align one of said time indicia thereon corresponding to said second time interval with said identified one of said radial pressure scales on said second polar graph on said rear face of said planar member, said helical line on said rear rotor thereby intersecting said identified one of said radial pressure scales at a radial increment thereon;

(e) using said intersected radial increment of said identified one of said radial pessure scales to identify a corresponding radial increment on said pressure group scale on said front rotor;

(f) rotating said front rotor until said identified radial increment on said pressure group scale thereon intersects one of said curved depth lines corresponding to said second depth; and (g) rotating said cursor until said crosshair is aligned with the limit point on said one of said curved depth lines corresponding to said second depth, said crosshair thereby relating said limit point on said one of said curved depth lines corresponding to said second depth to one of said time indicia on said front rotor, which one of said time indicia corresponds to the maximum time interval for which the diver can remain submersed at said second depth without havnig to undergo decompression.

6. The eive planning computer of claim 5, further comprising:

a pressure group indicium associated with each of said radial increments on said pressure group scale on said cursor; and a pressure range indicium associated with each of said radial pressure scales on said second polar graph, the pressure range indicium associated with a given one of said radial pressure scales corresponding to the pressure group indicium associated with the radial increment on said pressure group scale on said cursor to which said given one of said radial pressure scales on said second polar graph corresponds;

whereby the one of said radial pressure scales on said second polar graph corresponding to a radial increment on said pressure group scale on said cursor is easily identified by locating the one of said radial pressure scales having a pressure range indicium corresponding to the pressure group indicium of the radial increment.

7. The dive planning computer of claim 5, further comprising:

a pressure group indicium associated with each of said radial increments on said radial pressure scales on said second polar graph; and a pressure group indicium associated with each of said radial increments on said pressure group scale on said front rotor, the pressure group indicium associated with a given radial increment on said pressure group scale on said front rotor corresponding to the pressure group indicium associated with the corresponding radial increment on each of said increments on each of said radial pressurre scales on said second polar graph;

whereby the radial increment on said pressure group scale on said front rotor corresponding to a radial increment on a radial pressure scale on said second polar graph is easily identified by locating the radial increment on said pressure group scale on said front rotor having a pressure group indicium corresponding to the pressure group indicium of the radial increment of the radial pressure scale on said second polar graph.

8. The dive planning computer of claim 5, further comprising a plurality of isobars on said second polar graph connecting points representing equal pressures on said radial pressure scales, whereby visualization of differences in scale among different radial pressure scales is enhanced.

9. The dive planning computer of claim 5, wherein said time scale inscribed on said rear rotor is nonlinear.

10. The dive planning computer of claim 9, wherein said rear rotor further comprises a translucent portion for viewing through said rear rotor a portion of said second polar graph adjacent said helical line of said rear rotor.

* * * * *